US011691860B2

(12) United States Patent
Elzinga

(10) Patent No.: US 11,691,860 B2
(45) Date of Patent: Jul. 4, 2023

(54) DEVICE AND METHOD FOR UNSCREWING A LID FROM A CONTAINER BODY

(71) Applicant: Taco Elzinga, Haren (NL)

(72) Inventor: Taco Elzinga, Haren (NL)

( * ) Notice: Subject to any disclaimer, the term of this patent is extended or adjusted under 35 U.S.C. 154(b) by 552 days.

(21) Appl. No.: 16/967,852

(22) PCT Filed: Feb. 6, 2019

(86) PCT No.: PCT/NL2019/050076
§ 371 (c)(1),
(2) Date: Aug. 6, 2020

(87) PCT Pub. No.: WO2019/156557
PCT Pub. Date: Aug. 15, 2019

(65) Prior Publication Data

US 2021/0047164 A1 Feb. 18, 2021

(30) Foreign Application Priority Data

Feb. 7, 2018 (EP) ..... 18155528

(51) Int. Cl.
*B67B 7/18* (2006.01)
*B67B 7/44* (2006.01)

(52) U.S. Cl.
CPC . *B67B 7/18* (2013.01); *B67B 7/44* (2013.01)

(58) Field of Classification Search
CPC ..... B67B 7/18; B67B 7/44
See application file for complete search history.

(56) References Cited

U.S. PATENT DOCUMENTS 6,862,960 B2 3/2005 Chung
7,367,248 B2 * 5/2008 Ruffner ..... B67B 7/18 81/3.44

(Continued)

FOREIGN PATENT DOCUMENTS

CN 201343432 Y 11/2009
CN 202265381 U 6/2012

(Continued)

OTHER PUBLICATIONS

May 28, 2019, International Search Report and Written Opinion, PCT/NL2019/050076.

*Primary Examiner* — David B. Thomas
(74) *Attorney, Agent, or Firm* — Banner & Witcoff, Ltd.

(57) ABSTRACT

A device (1, 1') for at least partially unscrewing a lid (30) from a container body (31) has a lid engagement portion (3) and a container body engagement portion (13) each having opposite first (4, 14) and second ends (5, 15). Levers (20, 21) project from these first ends (4,14). An elastically expandable member (22) is connected between the second ends (5, 15) of the lid engagement portion (3) and the container body engagement portion (13). If the lid engagement portion (3) is in contact with the lid (30) and the container body engagement portion (13) is in contact with the container body (31), moving the levers (20, 21) towards each other first causes the lid (30) to be entrained relative to the container body engagement portion (13) and the container body (31) to be entrained relative to the lid engagement portion (3) while the elastically expandable member (22) is stretched.

11 Claims, 5 Drawing Sheets

(56) References Cited

U.S. PATENT DOCUMENTS

| | | | | |
|---|---|---|---|---|
| 8,001,872 | B2 * | 8/2011 | Gorrie | B67B 7/18 269/95 |
| 2008/0083302 | A1 * | 4/2008 | Hood | B67B 7/18 81/3.44 |
| 2013/0186240 | A1 | 7/2013 | Donahue | |

FOREIGN PATENT DOCUMENTS

| | | | |
|---|---|---|---|
| CN | 105460863 | A | 4/2016 |
| DE | 3721797 | A1 | 1/1989 |
| DE | 10208908 | A1 | 9/2003 |
| GB | 2265891 | A | 10/1993 |
| JP | S63107997 | U | 7/1988 |

* cited by examiner

DEVICE AND METHOD FOR UNSCREWING A LID FROM A CONTAINER BODY

CROSS-REFERENCE TO RELATED APPLICATIONS

This application is a U.S. National Stage application under 35 U.S.C. § 371 of International Application PCT/NL2019/050076 (published as WO 2019/156557 A1), filed Feb. 6, 2019, which claims the benefit of priority to Application EP 18155528.5, filed Feb. 7, 2018. Benefit of the filing date of these prior applications is hereby claimed. Each of these prior applications is hereby incorporated by reference in its entirety.

FIELD AND BACKGROUND OF THE INVENTION

The invention relates to a device and a method for at least partially unscrewing a lid from a container body.

Opening of a container, such as a jar, having a lid screwed onto a container body and closing off an open top of the container body is often difficult, because a large torque has to be exerted while both the lid and the container body provide little grip to a user's hands. In particular unscrewing lids of a large diameter and providing an airtight seal to the container body maintaining a vacuum inside the container is generally difficult, but also opening of containers of which the lids are simply screwed on very tightly (e.g. peanut butter, olives etc.) can be very difficult. Also lids of containers that have already been opened for use but, because the content is sticky (e.g. jam jars) cannot easily be unscrewed after some time. Opening is particularly difficult for persons having relatively little strength in their hands, such as children and elderly people.

Many openers for unscrewing lids have been and are available on the market that allow an increased torque to be exerted onto the lid, but ease of use is hampered by the need of holding the container body for exerting a counter torque preventing the container body from rotating in unison with the lid.

U.S. Pat. No. 6,862,960 discloses a device for loosening threaded lids from correspondingly threaded containers, comprising a body carrying first and second flexible belts forming first and second loops which engage around the lid and the container respectively, the belts being arranged to be relatively displaceable such that the first and second loops grip the lid and the container respectively, the belts further being arranged to be displaceable by an actuating means such that the first and second loops apply oppositely directed torques to the lid and container respectively whereby the lid is rotated on the container in a loosening direction. While this opener provides for exerting torques onto the lid and onto the container body, its application to a container is cumbersome and it provides little control over the container during opening and as the lid becomes loosened from the container body, which increases the risk of spilling contents from the opened container.

SUMMARY OF THE INVENTION

It is an object of the present invention to provide an opener for facilitating at least partial unscrewing of a lid from a container which is very easy to use and allows control over the container body as it is opened.

According to the invention, this object is achieved by providing an opener according to claim 1. The invention can also be embodied in a method according to claim 10.

Levers project from the lid engagement portions and an elastically expandable member is connected between the lid engagement portion and the container body engagement portion. Moving the levers towards each other causes the lid engagement surface to entrain the circumferential surface portion of the lid relative to the container body engagement portion, the container body engagement surface to entrain the circumferential surface portion of the container body relative to the lid engagement portion and the elastically expandable member to be elongated. Thus, the device can be operated in a very simple manner and an improved control over the opened container is provided during and after loosening of the lid, either via the levers or, mainly for smaller containers and lids, via a hand left free if the levers are operated with one hand.

If the levers are moved towards each other, the lid and the container body can be entrained in rotation relative to each other immediately or virtually immediately. However, if the circumferential surface of the lid and/or the circumferential surface of the container body are relatively slippery and/or the lid is screwed onto the container body very tightly, moving the levers towards each other may initially cause the lid engagement surface to slide along the circumferential surface portion of the lid and/or cause the container body engagement surface to slide along the circumferential surface portion of the container body. Meanwhile the elastically expandable member is then caused to be elongated and tensioned so that the clamping force exerted by the engagement surfaces is gradually increased until sufficient frictional force is exerted for entraining the lid and the container body relative to each other.

Particular elaborations and embodiments of the invention are set forth in the dependent claims.

Further features, effects and details of the invention appear from the detailed description and the drawings.

DETAILED DESCRIPTION

Figure 1:
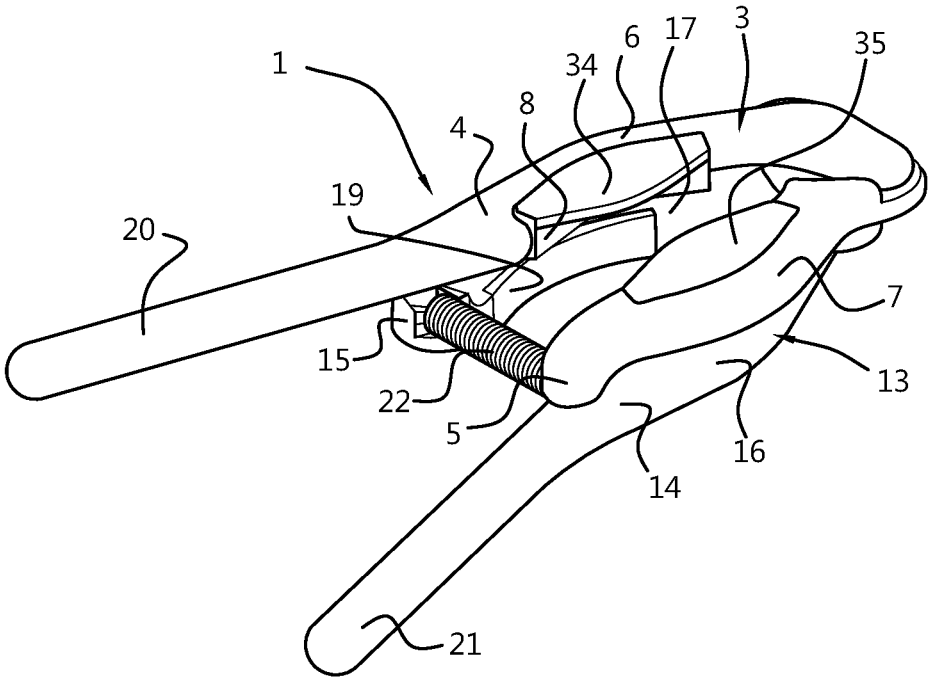
FIG. 1 is a perspective view of an example of a device according to the invention.
Figure 2:
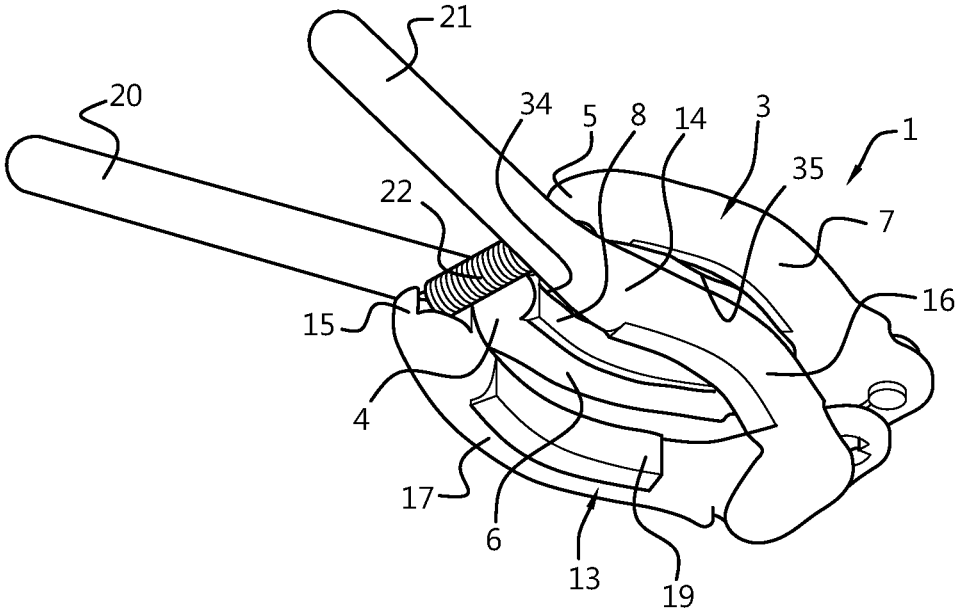
FIG. 2 is a second perspective view of the device shown in FIG. 1.
Figure 3:
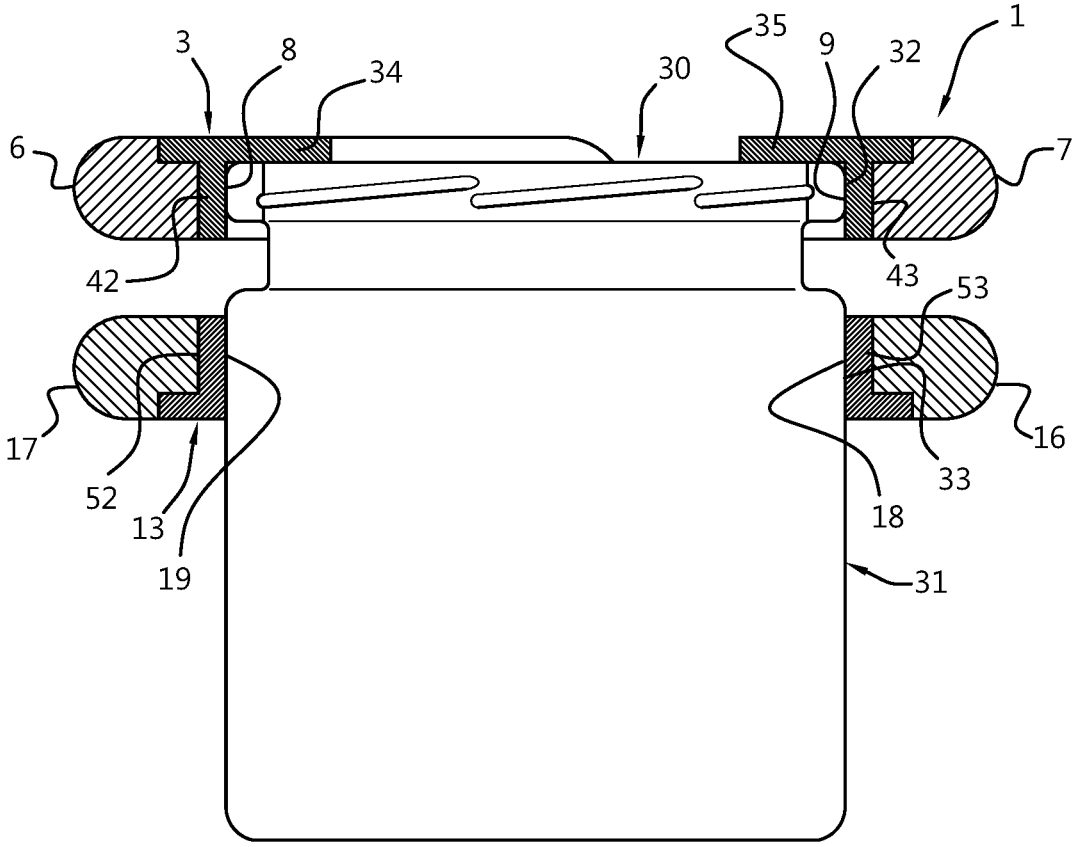
FIG. 3 is a cross sectional view of a device according to FIGS. 1 and 2 in use, seen along a plane through a center line of a container being opened.

The device shown in FIGS. 1-3 is for at least partially unscrewing a lid 30 from a container body 31. The device 1 has a lid engagement portion 3 having opposite first and second ends 4, 5 and having mutually articulated sections 6, 7 with lid engagement surfaces 8, 9 between the first and second ends 4, 5, the surfaces 8, 9 extending around a first free space for engaging the circumferential surface portion 32 of the lid 30 from opposite sides of the lid 30. Instead of in the form of articulated rigid sections 6, 7 as in the present example, the lid engagement portion may be in the form of one or more flexible sections, e.g. in the form of one or more strap sections that can be bent around the shape of the circumferential surface portion of the lid to be loosened. There may then be a single lid engagement surface only.

Furthermore, the device 1 has a container body engagement portion 13 having opposite first and second ends 14, 15 and having mutually articulated sections 16, 17 with container body engagement surfaces 18, 19 between the first and second ends 14, 15, the surfaces 18, 19 extending around a second free space for engaging the circumferential surface portion 33 of the container body 31 from opposite sides of the container body 31. Instead of in the form of articulated rigid sections 16, 17 as in the present example, also the container body engagement portion may be in the form of one or more flexible sections, e.g. in the form of one or more strap sections that can be bent around the shape of the circumferential surface portion of the container body. There may then be a single container body engagement surface only.

A first lever 20 projects from the first end 4 of the lid engagement portion 3 and a second lever 21 projects from the first end 14 of the container body engagement portion 13. An elastically expandable member in the form of a spring 22 is connected to extend between the second end 5 of the lid engagement portion 3 and the second end 15 of the container body engagement portion 13. Instead of a single spring, a plurality of springs or other elastically expandable members may be connected between the second end of the lid engagement portion and the second end of the container body engagement portion. Instead of in the form of a spring, the expandable member may for instance in the form of a rubber band.

In operative condition for opening a lid 30 on top of an upstanding container body 31, the lid engagement portion 3 is located closely above the container body engagement portion 13 and the spring 22 bridges the distance between the second ends 5, 15 of the lid engagement portion 3 and of the container body engagement portion 13, both in circumferential sense as in vertical direction, which is also the axial direction of the upstanding container. Thus, the spring 22 forms an obliquely oriented connection between a first level at which the lid engagement surfaces 8, 9 extend in circumferential sense when in contact with the circumferential surface portion 32 of the lid 30 and a second level at which the container body engagement surfaces 18, 19 extend in circumferential sense when in contact with the circumferential surface portion 33 of the container body 31.

The lid engagement portion 3, the container body engagement portion 13, the levers 20, 21 and the spring 22 are arranged such that, if the lid engagement surfaces 8, 9 are in contact with the circumferential surface portion 32 of the lid 30 and if the container body engagement surfaces 18, 19 are in contact with the circumferential surface portion 33 of the container body 31, moving the levers 20, 21 towards each other causes the lid engagement surfaces 8, 9 entrain the circumferential surface portion 32 of the lid 30 relative to the container body engagement portion 13 and the container body engagement surfaces 18, 19 entrain the circumferential surface portion 33 of the container body 31 relative to the lid engagement portion 3, while the spring 22 is elongated.

If the circumferential surface portion 32 of the lid 30 and/or the circumferential surface portion 33 of the container body 31 is/are slippery and/or if the lid is screwed onto the container body very tightly, moving the levers 20, 21 towards each other can initially cause the lid engagement surfaces 8, 9 to slide along the circumferential surface portion 32 of the lid 30 and/or causes the container body engagement surfaces 18, 19 to slide along the circumferential surface portion 33 of the container body 31 and causes the spring 22 to be elongated and tensioned. As the spring 22 is elongated and accordingly tensioned by the levers 20, 21, the increased spring tension causes the lid engagement portion 3 and the container engagement portion 13 to be pressed against the circumferential surface portions 32 and 33 of the lid 30 and, respectively, the container 31 with increased normal forces. As the normal forces exerted by the lid engagement portion 3 and the container engagement portion 13 against the lid 30 and, respectively, the container 31 increase, the friction forces exertable by the lid engagement surfaces 8, 9 to the circumferential surface portion 32 of the lid 30 and by the container body engagement surfaces 18, 19 to the circumferential surface portion 33 of the container body 31 increase accordingly. When the torque exerted by the friction forces increases to a level higher than the torque required for releasing the lid 30 from the container 31, the lid 30 and the container body 31 are entrained as described earlier. Meanwhile, the spring 22 is elongated further, so that it is ensured that during loosening the exerted normal forces remain above the level required for breaking loose the lid 30 from the container 31.

The spring 22 may be of a type under pre-tension, so that a pulling force below a certain minimum force (e.g. below 8-20 N or 11-17 N) does not result in any elongation of the spring. Thus, at a given spring constant, slipping stops already after the spring has expanded over a relatively short distance.

In released condition, the device 1 can be configured in the form of a string including, in order of succession, the first handle 20 and a section 6 of the lid engagement portion 3 fixed thereto, a further section 7 of the lid engagement portion 3, the spring 22, a section 17 of the container body engagement portion 13 and a further section 16 of the container body engagement portion 13 and the second handle 21 fixed thereto.

To facilitate generally simultaneous positioning of the lid engagement surfaces 8, 9 against the circumferential surface portion 32 of the lid 30 and of the container body engagement surfaces 18, 19 against the circumferential surface portion 33 of the container body 31, the lid engagement portion has abutments 34, 35 extending along and projecting from the lid engagement surfaces 8, 9. When arranging the lid and container engagement portions 3, 13 around the lid 30 and the container 31 respectively, the device 1 can simply be lowered until the abutments 34, 35 abut against the top of the lid 30. When the lid 30 and the container 31 are of dimensions suitable for being opened by the device 1, the lid engagement surfaces 8, 9 are then automatically located opposite of and against the circumferential surface portion 32 of the lid 30 and the container body engagement surfaces 18, 19 are then automatically located opposite of and against the circumferential surface portion 33 of the container body 31.

The device 1 according to the shown example is dimensioned for loosening lids 30 of jars 31 of various sizes and shapes, in particular having lids in a diameter range of about 5 to 9 cm and is preferably operated with two hands each holding one of the handles 20, 21 or, from the start. This provides easy control over the device. After the handles have been urged towards each other over some distance, operation with one hand is possible while the other hand holds the container body 31. Although not necessary for opening, holding the container body during at least a final stage of loosening of the lid can sometimes be practical, for instance for pouring the content into a pan or the like, immediately after opening or to avoid spilling if the container is extremely full.

The largest distance of the levers during operation may for instance decrease by 4-6 cm from about 8-25 cm to about 4-19 cm.

The device 1' shown in FIGS. 4-9 differs from the device 1 shown in FIGS. 1-3 in that the abutments 34, 35 are not provided.

Figure 4:
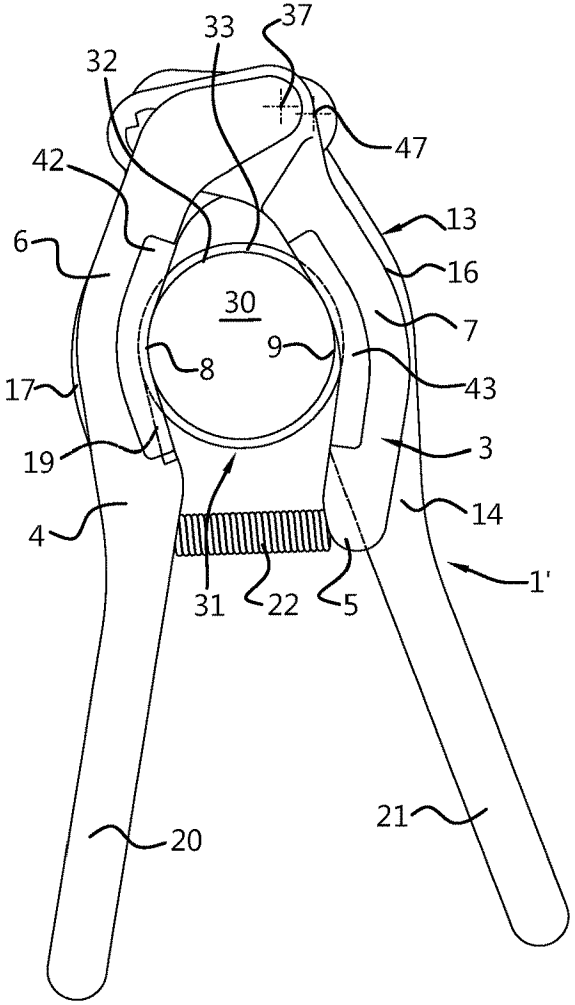

As shown in FIG. 4, for loosening lid 30 from container body 31, the lid engagement surfaces 8, 9 have been brought in positions in contact with the circumferential surface portion 32 of the lid 30 from opposite sides of the lid 30. The container body engagement surfaces 18, 19 have been brought in positions in contact with the circumferential surface portion 33 of the container body 31 from opposite sides of the container body 31.

The first lever 20 and the second lever 21 are in slightly (e.g. 5-25° angle) spread apart orientations projecting from, respectively, the lid engagement portion 3 and the container engagement portion 13. Thus, forces exerted on the levers for loosening the lid from the container body are oriented in in opposite directions and cancel each other out, so no additional forces are needed for holding the device and the container being opened thereby in position.

Figure 5:
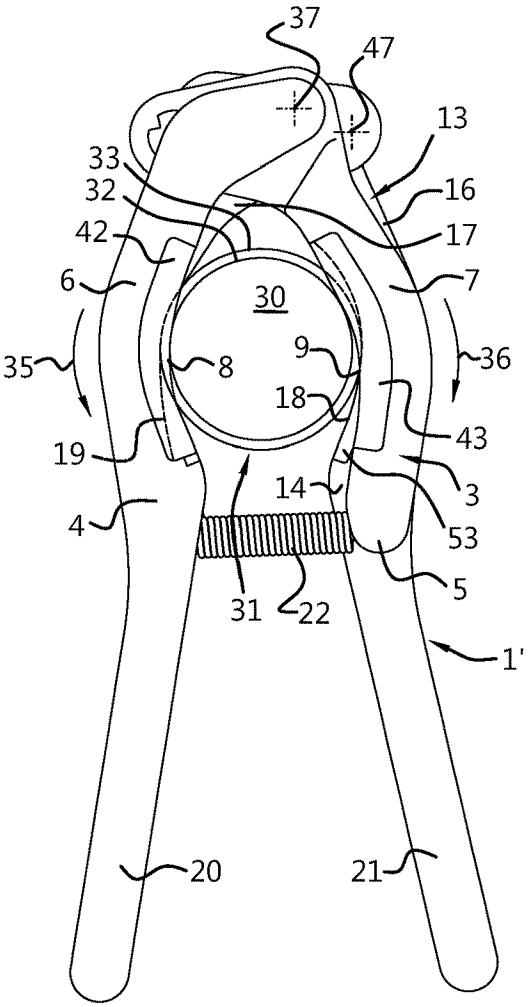

As shown in FIG. 5, the levers 20, 21 are moved towards each other, for instance by the user closing his or her hand holding the levers 20, 21. The rotation of the first lever 20 entrains the lid engagement portion 3 composed of mutually articulated sections 6, 7 in a left-hand sense of rotation 35 while rotation of the second lever 21 entrains the container body engagement portion 13 composed of mutually articulated sections 16, 17 in a right-hand sense of rotation 36. This results in the second ends 5, 15 of the lid engagement portion 3 and the container body engagement portion 13 moving away from each other, so that the spring 22 is stretched and tensioned.

Initially, the lid engagement surfaces 8, 9 may slide along the circumferential surface portion 32 of the lid 30 and/or the container body engagement surfaces 18, 19 may slide along the circumferential surface portion 33 of the container body 31. However, at least as the spring 22 is stretched and thereby tensioned, it pulls the second ends 5, 15 of the lid engagement portion 3 and the container body engagement portion 13 towards each other, thereby exerting a counter force opposite to forces exerted by the levers 20, 21 urging the first ends 4, 14 of the lid engagement portion 3 and the container body engagement portion 13 towards each other. These forces urging these first ends 4, 14 and these second ends 5, 15 towards each other cause the lid engagement surfaces 8, 9 and the container body engagement surfaces 18, 19 to be pressed against the lid 30 and, respectively, the container body 31 with an increased normal force. As the normal force increases friction forces transferred to the lid 30 and to the container body increase up to a level where the torque exerted by the friction forces exceeds the torque required for loosening the lid 30 from the container body 31. Depending on pretension built-in in the spring 22, coefficients of friction between the engagement surfaces and the surfaces of the lid and the container body contacted thereby and the torque required for loosening the lid, the torque exerted by the friction forces may also exceed the torque required for loosening the lid 30 from the container body 31 immediately, without initial slip of lid engagement surfaces 8, 9 along the circumferential surface portion 32 of the lid 30 and/or of the container body engagement surfaces 18, 19 along the circumferential surface portion 33 of the container body 31.

Figure 6:
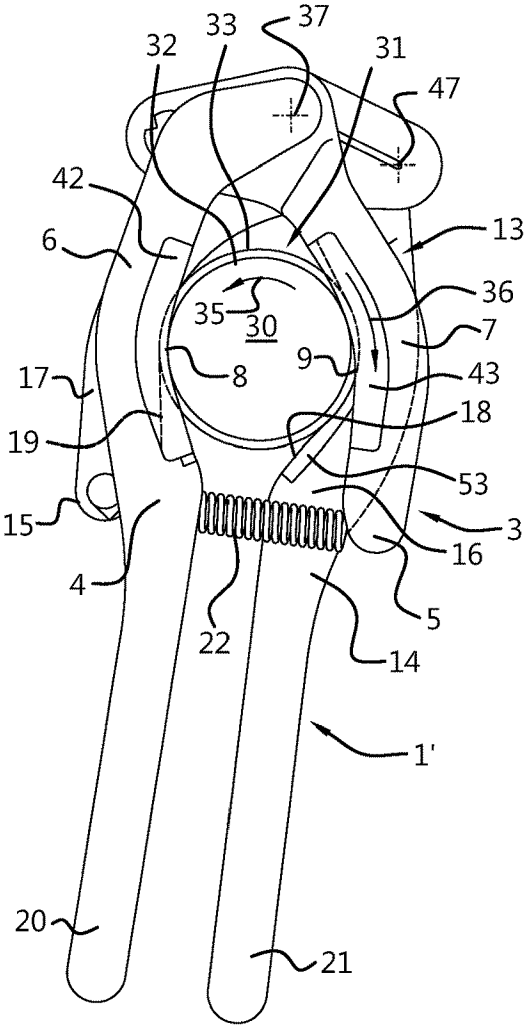
FIGS. 4-6 are top plan views of a device similar to the device shown in FIGS. 1 and 2 in successive stages of a first mode of operation.

As illustrated by the transition from FIG. 5 to FIG. 6, the lid engagement surfaces 8, 9 entrain the lid 30 relative to the container body engagement portion 13 and the container body engagement surfaces 18, 19 entrain the container body 31 relative to the lid engagement portion 3, so that the lid 30 is twisted relative to the container body 31 and thereby at least partially unscrewed from the container body 31. During twisting of the lid 30 relative to the container body 31, the spring 22 stretches, so that it is reliably ensured that the normal pressure is maintained high enough to avoid renewed slipping of the lid engagement surfaces 8, 9 and the container body engagement surfaces 18, 19.

When the handles 20, 21 are released the removal of the forces urging the first ends 4, 14 of the lid engagement portion 3 and, respectively, the container body engagement portion 13 towards each other results in a reduction of normal forces by removal of the strangling effect around the lid 30 and the container body 31. Thus, the resulting recontraction of the spring 22 does not cause the lid 30 to be screwed back onto the container body 31, at least not with a torque nearly as high as the torque that was required for loosening the lid 30 from the container body 31. Thus, the lid 30 remains loose or can easily be unscrewed manually after having been loosened by the device 1'.

In the present example, two upper parts 6, 7 forming the lid engagement portion 3 are mutually articulated by means of a pivot hinge 37 that allows the parts 6, 7 to accommodate to the contour of the lid 30. Similarly, two lower parts 16, 17 forming the container body engagement portion 13 are mutually articulated by means of a pivot hinge 47 that allows the parts 16, 17 to accommodate to the contour of the container body 31. This provides a limitation to relative movability of components of the device 1', which in turn makes handling of the device 1' particularly easily.

Figure 7:
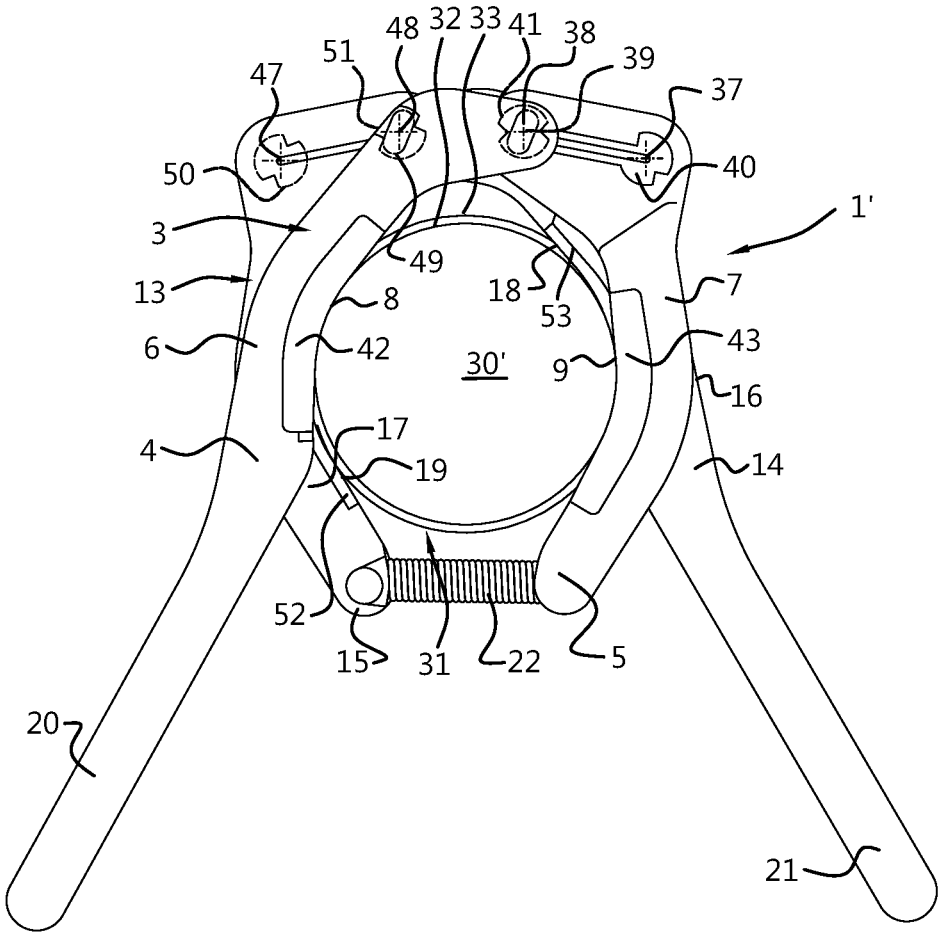
FIGS. 7-9 are top plan views of the device shown in FIGS. 4-6 in successive stages of a second mode of operation.
Figure 9:
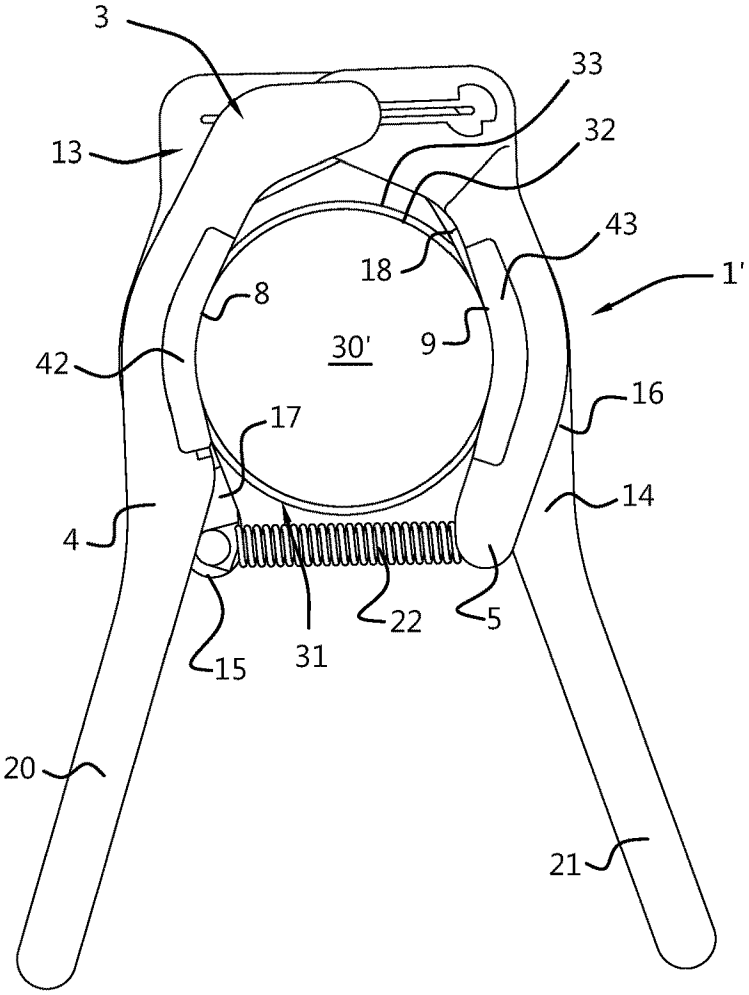
Figure 8:
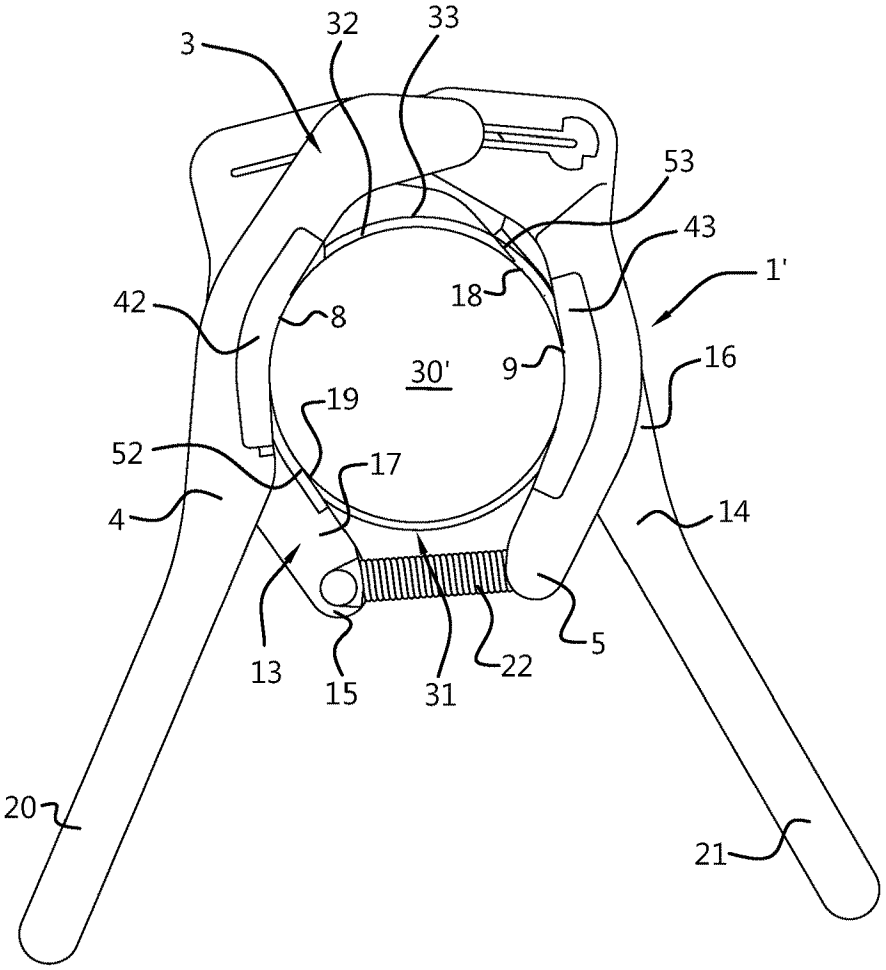

As is illustrated by FIGS. 7-9, the hinge is adjustable for allowing hinging of the rigid parts 6, 7 and 16, 17 relative to each other about a selected one of at least two mutually spaced pivot hinges 37, 38 and 47, 48. This allows the device 1' to be used in two different modes of operation, one for loosening lids 30 of a first diameter range (FIGS. 4-6) and one for loosening lids 30' of a second range of diameters larger than the diameters of the first diameter range. Preferably there is some overlap between the two diameter ranges.

In the present example, the adjustability of the hinges between first and second pivot hinges 37, 38 and 47, 48 is realized by providing, for each adjustable hinge, a hinge pin 39, 49 and hinge holes 40, 41 and 50, 51 shaped for allowing movement of the pin 39, 49 from a first one of the holes 40, 50 to a second one of the holes 41, 51 or vice versa if the rigid parts 6, 7 or, respectively, 16, 17 are pivoted into a non-operative configuration, while the pin 39, 49 is prevented from displacement from the first one of the holes 40, 50 to the second one of the holes 41, 51 or vice versa if the rigid parts 6, 7 or, respectively, 16, 17 are pivoted into an operative configuration for causing the engagement surfaces to engage the lid 30 or 30' or the container body 31 or 31'.

The lid engagement surfaces 8, 9 and the container body engagement surfaces 18, 19 are surfaces of a first material 42, 43, 52, 53, such as rubber or a synthetic elastomer of a mixture thereof, which is more resilient and has a higher frictional coefficient to glass, metal and painted surfaces than a second material of which other portions of the lid engagement portion 3 and the container body engagement portion 13 are formed. Thus, a relatively high friction can be generated at moderate clamping forces and the risk of damage to the lid 30, 30' or to the container body 31, 31' is reduced.

Several features have been described as part of the same or separate embodiments. However, it will be appreciated that the scope of the invention also includes embodiments having combinations of all or some of these features other than the specific combinations of features embodied in the examples.

The invention claimed is:

1. A device for at least partially unscrewing a lid from a container body, the device comprising:

a lid engagement portion having opposite first and second ends and having at least one flexible section or mutually articulated sections with at least one lid engagement surface between said first and second ends extending around a first free space for engaging the circumferential surface portion of the lid from opposite sides of the lid;

a container body engagement portion having opposite first and second ends and having at least one flexible section or mutually articulated sections with at least one container body engagement surface between said first and second ends extending around a second free space for engaging the circumferential surface portion of the container body from opposite sides of the container body;

a first lever projecting from the first end of the lid engagement portion;

a second lever projecting from the first end of the container body engagement portion; and an elastically expandable member connected to extend between the second end of the lid engagement portion and the second end of the container body engagement portion;

wherein said lid engagement portion, said container body engagement portion, said levers and said elastically expandable member are arranged such that, if said lid engagement surface is in contact with the circumferential surface portion of the lid and if said container body engagement surface is in contact with the circumferential surface portion of the container body, moving the levers towards each other causes said lid engagement surface to entrain the circumferential surface portion of the lid relative to the container body engagement portion, said container body engagement surface to entrain the circumferential surface portion of the container body relative to the lid engagement portion and said elastically expandable member to be elongated.

2. The device according to claim 1, wherein at least the lid engagement portion or the container body engagement portion comprises at least two generally rigid parts mutually articulated via a hinge between the lid or, respectively, the container body engagement surfaces on opposite sides of the hinge.

3. The device according to claim 2, wherein said hinge is adjustable for allowing hinging of the rigid parts relative to each other about a selected one of at least two mutually spaced pivot hinges.

4. The device according to claim 3, wherein a hinge pin and hinge holes are shaped for allowing movement of the pin from a first one of the holes to a second one of the holes or vice versa if the rigid parts are pivoted into a non-operative configuration, while the pin is prevented from displacement from the first one of the holes to the second one of the holes or vice versa if the rigid parts are pivoted into an operative configuration for causing the engagement surfaces to engage the lid or the container body.

5. The device according to claim 1, wherein in released condition, the device can be configured in the form of a string including, in order of succession, the first handle and a portion of the lid engagement portion fixed thereto, a further portion of the lid engagement portion, the elastically expandable member, a portion of the container body engagement portion and a further portion of the container body engagement portion and the second handle fixed thereto.

6. The device according to claim 1, wherein, in operative position, the elastically expandable member forms a step from a first level at which the lid engagement surfaces extend in circumferential sense when in contact with the circumferential surface portion of the lid and a second level at which the container body engagement surfaces extend in circumferential sense when in contact with the circumferential surface portion of the container body.

7. The device according to claim 1, wherein the lid engagement surfaces and the container body engagement surfaces are surfaces of a first material which is more resilient and has a higher frictional coefficient to glass, metal and painted surfaces than a second material of which other portions of the at least one lid engagement portion and the at least one container body engagement portion are formed.

8. The device according to claim 1, wherein the lid engagement portion has at least one abutment extending along and projecting from the at least one lid engagement surface.

9. The device according to claim 1, wherein, if said lid engagement surface is in contact with the circumferential surface portion of the lid and if said container body engagement surface is in contact with the circumferential surface portion of the container body, moving the levers towards each other first causes at least said lid engagement surface to slide along the circumferential surface portion of the lid or said container body engagement surface to slide along the circumferential surface portion of the container body and causes said elastically expandable member to be elongated and tensioned.

10. A method of at least partially unscrewing a lid from a container body, using a device comprising:

a lid engagement portion having opposite first and second ends and having at least one flexible section or mutually articulated sections with at least one lid engagement surface between said first and second ends engaging the circumferential surface portion of the lid from opposite sides of the lid;

a container body engagement portion having opposite first and second ends and having at least one flexible section or mutually articulated sections with at least one container body engagement surface between said first and second ends engaging the circumferential surface portion of the container body from opposite sides of the container body;

a first lever projecting from the first end of the lid engagement portion;

a second lever projecting from the first end of the container body engagement portion; and an elastically expandable member connected to the lid engagement portion and to the second end of the container body engagement portion and extending between the second end of the lid engagement portion and the second end of the container body engagement portion;

the method comprising moving the levers towards each other causing said lid engagement surface to entrain the circumferential surface portion of the lid relative to the container body engagement portion, said container body engagement surface to entrain the circumferential surface portion of the container body relative to the lid engagement portion and said elastically expandable member to be elongated.

11. The method according to claim 10, wherein moving the levers towards each other first causes at least said lid engagement surface to slide along the circumferential surface portion of the lid or said container body engagement surface to slide along the circumferential surface portion of the container body and causes said elastically expandable member to be elongated and tensioned.

* * * * *